US010115384B2

(12) United States Patent
Abe

(10) Patent No.: US 10,115,384 B2
(45) Date of Patent: Oct. 30, 2018

(54) PICKUP APPARATUS FOR MUSICAL INSTRUMENT

(71) Applicant: Abeseishi Ltd., Fukushima (JP)

(72) Inventor: Yoshitake Abe, Fukushima (JP)

(73) Assignee: Abeseishi Ltd., Fukushima (JP)

( * ) Notice: Subject to any disclaimer, the term of this patent is extended or adjusted under 35 U.S.C. 154(b) by 0 days.

(21) Appl. No.: 15/743,318

(22) PCT Filed: Dec. 7, 2016

(86) PCT No.: PCT/JP2016/086381
§ 371 (c)(1),
(2) Date: Jan. 10, 2018

(87) PCT Pub. No.: WO2017/104506
PCT Pub. Date: Jun. 22, 2017

(65) Prior Publication Data

US 2018/0211645 A1 Jul. 26, 2018

(30) Foreign Application Priority Data

Dec. 14, 2015 (JP) ..... 2015-242993

(51) Int. Cl.
*G10H 3/03* (2006.01)
*G10H 3/18* (2006.01)
*G10H 3/14* (2006.01)

(52) U.S. Cl.
CPC ..... *G10H 3/183* (2013.01); *G10H 3/143* (2013.01)

(58) Field of Classification Search
CPC ..... G06F 3/0414; G10H 2220/525; G10K 2210/3229
See application file for complete search history.

(56) References Cited

U.S. PATENT DOCUMENTS 6,031,176 A * 2/2000 Tanaka ..... G10H 3/146 84/730
6,072,112 A * 6/2000 Suenaga ..... G10H 3/146 84/422.3

(Continued)

FOREIGN PATENT DOCUMENTS

| | | |
|---|---|---|
| JP | 53-79004 | 7/1978 |
| JP | 53-147667 | 11/1978 |
| JP | 2015-075564 | 4/2015 |

OTHER PUBLICATIONS

Search Report in International Application No. PCT/JP2016/086381 dated Feb. 21, 2017, 2 pages.

(Continued)

*Primary Examiner* — Marlon Fletcher
(74) *Attorney, Agent, or Firm* — Marshall, Gerstein & Borun LLP

(57) ABSTRACT

The present application discloses a pickup apparatus for a musical instrument, configured to improve sound quality of a musical instrument to a greatest possible degree, obtained by a piezoelectric element. The pickup apparatus, for the musical instrument, to be fixed to the musical instrument, includes: a disc-shaped piezoelectric element; a couple of circular members receiving interposition of the piezoelectric element therebetween; and leg portions being arranged on a surface of any one of the couple of circular members, each circular member having protrusions formed protrusively toward the other circular member in two positions along a peripheral edge of an opposite surface in a face-to-face relationship with the other circular member, the piezoelectric element being supported within an air gap formed by the protrusions between the couple of circular members in a state of the piezoelectric element being interposed between the protrusions possessed by the respective circular wood members.

8 Claims, 7 Drawing Sheets

(56) References Cited

U.S. PATENT DOCUMENTS

| | | | | |
|---|---|---|---|---|
| 6,075,198 | A * | 6/2000 | Grant | G10H 3/181 84/291 |
| 6,326,539 | B1 * | 12/2001 | Mishima | G10H 3/14 36/139 |
| 7,220,903 | B1 * | 5/2007 | Bronen | G10D 9/02 84/383 R |
| 7,459,626 | B2 * | 12/2008 | Yoshino | G10H 1/34 84/723 |
| 2005/0011342 | A1 * | 1/2005 | Fishman | G10H 3/143 84/730 |
| 2005/0039593 | A1 * | 2/2005 | Wachter | G10H 3/146 84/730 |
| 2012/0118130 | A1 * | 5/2012 | Field | G10H 3/146 84/730 |
| 2014/0150627 | A1 * | 6/2014 | Chekardzhikov | G10G 7/02 84/455 |
| 2015/0082970 | A1 * | 3/2015 | Chekardzhikov | G10G 7/02 84/455 |
| 2016/0140941 | A1 * | 5/2016 | Kobayashi | G10D 3/04 84/3 |
| 2017/0229104 | A1 * | 8/2017 | Suitor | G10H 1/0558 |
| 2018/0005619 | A1 * | 1/2018 | Suitor | G10H 3/143 |

OTHER PUBLICATIONS

International Preliminary Report on Patentability and Written Opinion in International Application No. PCT/JP2016/086381 dated Jun. 28, 2018, 6 pages.

* cited by examiner

PICKUP APPARATUS FOR MUSICAL INSTRUMENT

TECHNICAL FIELD

The present invention pertains to a pickup apparatus using a piezoelectric element (which is called a "piezoelectric device" in some cases) in the pickup apparatuses (which will hereinafter be simply termed "pickups"), for musical instruments, configured to convert sounds of acoustic string instruments typified by a contrabass, pianos and other various categories of musical instruments into electric signals.

BACKGROUND ART

A variety of apparatuses to convert the sounds of the musical instruments into the electric signals are proposed (refer to, e.g., Patent document 1).

DOCUMENTS OF PRIOR ARTS

Patent Document

[Patent document 1] Japanese Patent Application Laid-Open Publication No. 2015-075564

SUMMARY OF THE INVENTION

Problems to be Solved by the Invention

For instance, a string instrument instanced by a contrabass of a bass range is played, in which case it is not easy to provide "low-pitched sounds" liable to blur to audiences clearly and sufficiently. In particular, when playing an ensemble of the contrabass with other musical instruments, especially an electric guitar and various types of electric musical instruments characterized by electrically picking up the sounds, it is not easy to sufficiently reverberate the sounds of the contrabass in a way that balances sound volumes of the two musical instruments.

To solve this problem, it may be sufficient to simply amplify the sounds of the string instrument of the bass range like the contrabass by converting the sounds into electric signals. A method of converting the sounds of the contrabass into the electric signals is exemplified by a method of collecting the sounds in a way that sets a microphone in the vicinity of an f-hole (f-shaped hole: sound hole) of a body of the contrabass. However, the sounds are collected by setting the microphone in the vicinity of the f-hole of the body of the contrabass, in which case a player is unable to freely move the contrabass. Such being the case, a method liable to be preferred by the player in terms of flexibility is that the microphone is fitted directly to the body of the contrabass.

By the way, the apparatus to convert the sounds into the electric signals is exemplified by a dynamic type of contact microphone, and generally this contact microphone has, however, a problem of being large in size and high in price, with the result that piezoelectric elements are frequently used in recent years. A variety of methods about positions of fitting the pickup apparatus are proposed as below for the pickup apparatus using the piezoelectric element for the string instrument. These methods are:

(1) a method of providing the pickup apparatus at a retaining member that spans a "bridge crotch" (inversely U-shape space between one bridge foot and another bridge foot) of a bridge of the string instrument, and amplifying the electric signals fetched by the pickup apparatus;

(2) a method of pasting the piezoelectric element directly to the bridge;

(3) a method of fitting the piezoelectric element in a gap between "bridge wings" of the bridge;

(4) a method of pinching the piezoelectric element with the bridge by using a clip and other equivalent tools immediately close to the strings stretching on the bridge;

(5) a method of retaining the piezoelectric element by pinching the piezoelectric element with a decorative portion of the bridge;

(6) a method of embedding the piezoelectric element into holes formed in the bridge (a number of holes may be arbitrary such as 1, 2 or 4 in the case of a four-strings instrument); and (7) a method of incorporating the piezoelectric element into a "bridge adjuster" for adjusting a height of the bridge.

However, each method of installing the piezoelectric element by applying the piezoelectric element to the bridge of the string instrument, though having advantages, is liable to mainly pick up only the sounds of the "strings" and is unable to obtain a sufficient sound pressure. Though depending on preferences of the player, there are many cases of not acquiring a pleasant sound quality. This being the case, following different means (methods) are proposed, which install the piezoelectric element by applying the piezoelectric element to a top plate of a body of the string instrument:

(A) a method of interposing the piezoelectric element between the bridge and the top plate (between bridge feet and the top plate); and (B) a method of pasting the piezoelectric element directly to the top plate by using an adhesive agent having a low viscosity.

However, in the case of the method (A), though any reason is not elucidated, there are obtained only the insufficient electric signals not having core of sound. Also when based on the method (B), the piezoelectric element composed of a metal piece is pasted directly to the top plate and therefore might damage a body of the musical instrument in some cases, and the piezoelectric element appears to be unsatisfactory because the piezoelectric element pasted to the musical instrument is exposed. It is also empirically recognized that the apparatus configured to simply "paste" the piezoelectric element to the top plate, though not particularly causing a hindrance in the musical instruments instanced by a guitar and a violoncello having higher-pitched sounds than the contrabass, does not exhibit the core of sounds when used for the musical instruments instanced by the contrabass having low-pitched sounds.

Such being the case, though there is proposed a method of fitting the piezoelectric element to the top plate of the string instrument by magnetic force of a magnet, a weight of the magnet depresses the vibrations of the top plate, and, especially in the case of sounds that are low in pitch and large in amplitude like the contrabass, the sounds are converted into the electric signals in the form of being different from original sounds in some cases.

Under such circumstances, the present application discloses a pickup apparatus for a musical instrument, which is configured to improve sound quality of a musical instrument to a greatest possible degree, obtained by a piezoelectric element.

Means for solving the Problems

To solve the problems described above, the present invention has such contrivances that a pickup apparatus is fixed to a musical instrument and is configured to pinch a piezoelectric element by protrusions provided respectively on a couple of circular members, and any one of the circular members includes leg portions provided on a surface.

Specifically, according to the present invention, a pickup apparatus, for a musical instrument, to be fixed to the musical instrument, includes: a disc-shaped piezoelectric element; a couple of circular members receiving interposition of the piezoelectric element therebetween; and leg portions being arranged on a surface of any one of the couple of circular members, each circular member including protrusions formed protrusively toward the other circular member in two positions along a peripheral edge of an opposite surface in a face-to-face relationship with the other circular member, the piezoelectric element being supported within an air gap formed by the protrusions between the couple of circular members in a state of the piezoelectric element being interposed between the protrusions possessed by the respective circular wood members.

In the pickup apparatus for the musical instrument, the piezoelectric element in a state of being interposed between the couple of circular members is fixed to the musical instrument. The piezoelectric element fixed to the musical instrument vibrates together with the circular members when playing the musical instrument. In the pickup apparatus for the musical instrument, the piezoelectric element is pinched by the protrusions provided in two positions respectively along peripheral edges of opposite surfaces, taking a face-to-face relationship, of the couple of circular members, and is in a state of being supported at two points, and hence the whole piezoelectric element vibrates. The whole piezoelectric element vibrates, whereby a piezoelectric material layer between two electrodes existing in the piezoelectric element receives force on the whole. Sounds are thereby enabled to be converted into electric signals more preferably than when the piezoelectric element receives the vibrations locally.

Note that the piezoelectric element may include a circular lower electrode layer, a piezoelectric material layer smaller in diameter than the lower electrode layer, and an upper electrode layer formed on the piezoelectric material layer, and the lower electrode layer is interposed between the couple of circular members in a state of contacting the protrusions. The thus-configured piezoelectric material is used, thereby enabling the piezoelectric material layer to receive the force on the whole because an area formed with the piezoelectric material layer and the upper electrode layer does not contact the protrusions.

The leg portions may be configured by leather portions arranged equally at three points along an edge of a surface of any one of the circular members. The circular members between which to interpose the piezoelectric element are supported by the leg portions on the musical instrument, and the pickup apparatus for the musical instrument is thereby enabled to be stably fixed to the musical instrument, resulting in no possibility of damaging the musical instrument.

The protrusions may be arranged symmetrically about a central point of each circular member. When the protrusions are arranged symmetrically about the central point of each circular member, the piezoelectric element is oscillated from both ends in such a manner that the overall piezoelectric element gets flexural. As a result, the piezoelectric element does not receive the vibrations locally, and the sounds are enabled to be converted preferably into the electric signals.

The musical instrument is a string instrument having an f-hole, and the pickup apparatus for the musical instrument may be fixed by a clamp to an edge of the f-hole. The f-hole is formed in a top plate of a string instrument, and, when the pickup apparatus for the musical instrument is fixed to an edge of the f-hole, the piezoelectric element vibrates together with the circular members when playing the string instrument, thereby enabling sounds of the string instrument to be converted into electric signals.

The clamp may be composed of a wood material with respect to members other than a screw contacting the circular member. When a large portion of the clamp is composed of the wood material, vibrations of the top plate of the string instrument become hard to be depressed due to a mass of the clamp, and sounds propagated to the piezoelectric element via the clamp also become hard to be depressed, thereby enabling the vibrations of the top plate of the string instrument to be preferably propagated to the piezoelectric element.

The circular member may be composed of the wood material. When the circular member is composed of the wood material, the vibrations of the musical instrument become hard to be depressed due to a mass of the circular members, and the sounds propagated to the piezoelectric element also become hard to be depressed due to the mass of the circular members, thereby enabling the vibrations of the musical instrument to be preferably propagated to the piezoelectric element.

Each of the wood materials may be spruce. The spruce, which has rigidity suited to propagation of the vibrations and is small in mass, is therefore enabled to properly propagate the vibrations of the musical instrument to the piezoelectric element when the spruce is used as the wood material composing the respective portions of the pickup apparatus for the musical instrument.

Effects of the Invention

The present invention improves the sound quality of the musical instrument to the greatest possible degree, which are obtained by the piezoelectric element.

MODE FOR CARRYING OUT THE INVENTION

An embodiment of the present invention will hereinafter be described. Note that the embodiment, which will hereinafter be described, is an exemplification, and the present invention is not limited to a specific configuration that will be described below. On the occasion of carrying out the invention, specific configurations corresponding to embodiments may be properly adopted.

Figure 1:
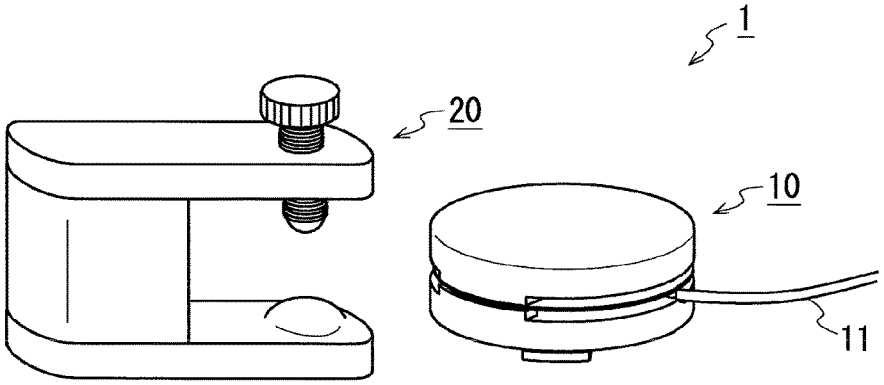
FIG. 1 is a view illustrating one example of a pickup apparatus for a musical instrument.

FIG. 1 is a view illustrating a pickup apparatus for a musical instrument (which will hereinafter be simply termed the "pickup apparatus"). A pickup apparatus 1 includes, as illustrated in FIG. 1, a pickup apparatus body 10. The pickup apparatus body 10 is a device fixable by a clamp 20 to an edge of an f-hole of a string instrument, and is enabled to convert sounds of the string instrument into electric signals. The pickup apparatus body 10 is provided with a coaxial cable 11, and outputs the electric signals to an amplifier and other equivalent equipments connected to the coaxial cable 11.

Figure 2:
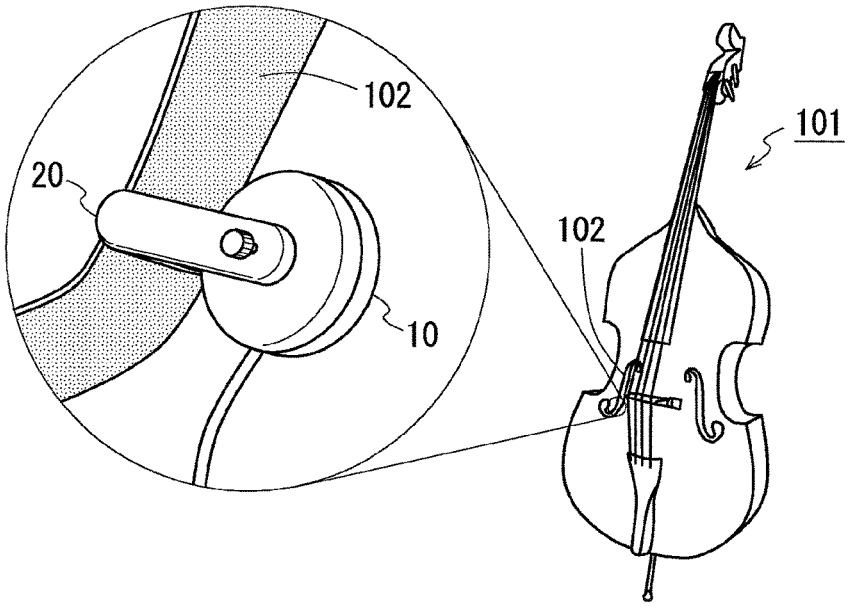
FIG. 2 is a view illustrating one example of a state of fitting the pickup apparatus.

FIG. 2 is a view illustrating one example of a state of how the pickup apparatus 1 is fitted. For example, as illustrated in FIG. 2, the pickup apparatus body 10 is fixed by the clamp 20 to an edge of an f-hole 102 of a contrabass 101 classified as one of the string instruments, and the pickup apparatus 1 is thereby enabled to convert sounds of the contrabass 101 into the electric signals.

Figure 3:
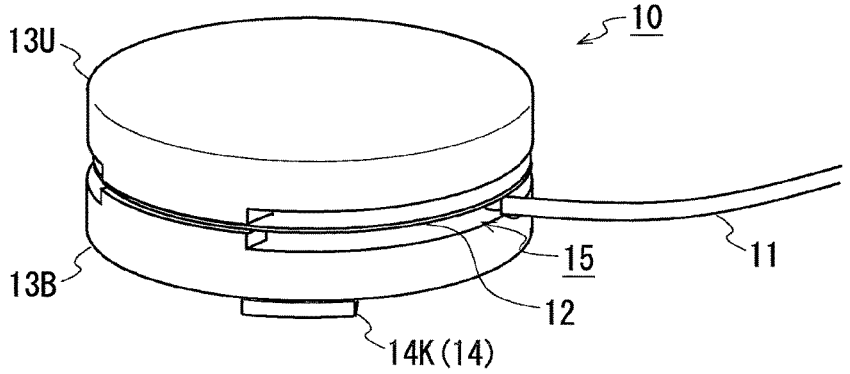
FIG. 3 is a view of an external appearance of a pickup apparatus body.
Figure 4:
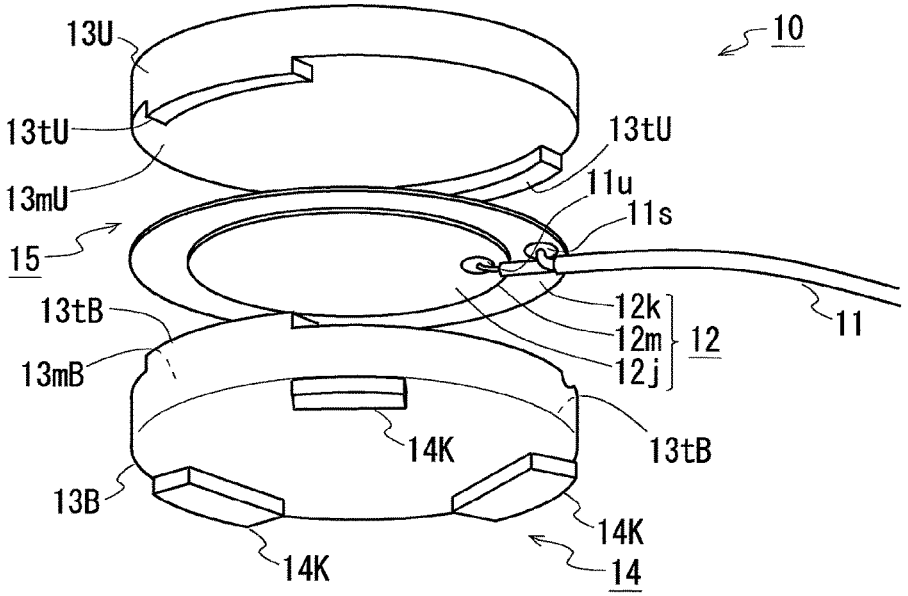
FIG. 4 is an exploded view of the pickup apparatus body.

FIG. 3 is a view of an external appearance of the pickup apparatus body 10. FIG. 4 is an exploded view of the pickup apparatus body 10. The pickup apparatus body 10 includes, as depicted in FIGS. 3 and 4, a disc-shaped piezoelectric element 12, a couple of circular wood members (which are one example of "circular members" according to the present application) 13U, 13B between which the piezoelectric element 12 is interposed, and leg portions 14 configured by three leather portions 14*k*, 14*k*, 14*k* arranged on a surface (undersurface) of the circular wood member 13B that is one of the couple of circular wood members 13U, 13B. The three leather portions 14*k*, 14*k*, 14*k* are arranged substantially equally in three positions along a peripheral edge of the surface of the circular wood member 13B. Note that in the pickup apparatus 1 according to the embodiment, the circular wood members 13U, 13B may be composed of a raw material other than a wood, and the leg portions 14 may be composed of a raw material (e.g., the wood) other than the leather material.

The circular wood members 13U, 13B are circular woods each having a substantially same outside diameter as an outside diameter of the circular piezoelectric element 12. The circular wood member 13U has protrusions 13*t*U formed protrusively toward the other circular wood member 13B in two positions along a peripheral edge of an opposite surface 13*m*U that is in a face-to-face relationship with the circular wood member 13B. Similarly to the circular wood member 13U, the circular wood member 13B also has protrusions 13*t*B formed protrusively toward the other circular wood member 13U in two positions along a peripheral edge of an opposite surface 13*m*B that is in the face-to-face relationship with the circular wood member 13U. The two protrusions 13*t*U, 13*t*U are arranged symmetrically about a central point of the circular wood member 13U. Similarly to the protrusions 13*t*U, 13*t*U, the protrusions 13*t*B, 13*t*B are also arranged symmetrically about a central point of the circular wood member 13B.

The piezoelectric element 12 includes a circular lower electrode layer 12*k*, a piezoelectric material layer 12*m* having a diameter smaller than a diameter of the lower electrode layer 12*k*, and an upper electrode layer 12*j* formed on the piezoelectric material layer 12*m*. The piezoelectric element 12 is interposed between the couple of circular wood members 13U, 13B in such a state that the lower electrode layer 12*k* contacts both of the protrusions 13*t*U of the circular wood member 13U and the protrusions 13*t*B of the circular wood member 13B. Both of the lower electrode layer 12*k* and the upper electrode layer 12*j* are electrodes composed of conductive materials. The piezoelectric material layer 12*m* is a piezoelectric substance to vary a voltage between the lower electrode layer 12*k* and the upper electrode layer 12*j* by a sound pressure applied to the piezoelectric material layer 12*m* defined as the piezoelectric substance, and is a layer composed of, e.g., ceramic and other equivalent materials. The piezoelectric element 12 is supported within an air gap 15 formed by the protrusions 13*t*U, 13*t*B between the couple of circular wood members 13U, 13B in such a state that the piezoelectric element 12 is interposed between the two protrusions 13*t*U, 13*t*U possessed by the circular wood member 13U and the two protrusions 13*t*B, 13*t*B possessed by the circular wood member 13B. The piezoelectric element 12 contacts the protrusions 13*t*U, 13*t*U, 13*t*B, 13*t*B at the outer peripheral edge of the lower electrode layer 12*k*. The piezoelectric element 12 is bonded to the lower electrode layer 12*k* at the contact portions with the protrusions 13*t*U, 13*t*U, 13*t*B, 13*t*B. In the piezoelectric element 12, the lower electrode layer 12*k* is soldered to an external conductor 11*s* of the coaxial cable 11, while the upper electrode layer 12*j* is soldered to an internal conductor 11*u* of the coaxial cable 11.

Figure 5:
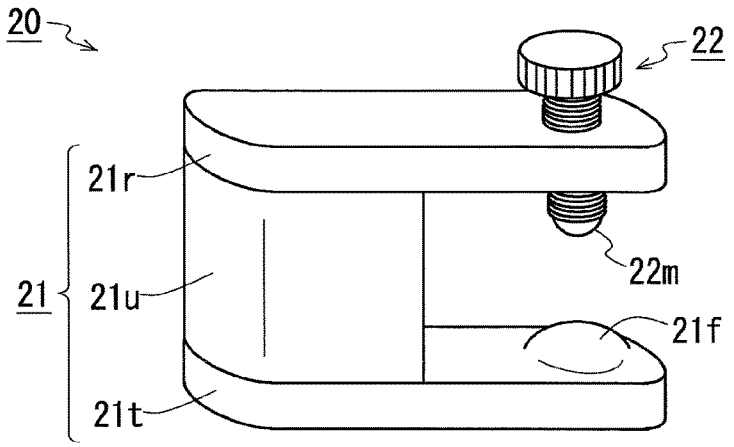
FIG. 5 is an enlarged view of a clamp.

FIG. 5 is an enlarged view of the clamp 20. The clamp 20 includes, as illustrated in FIG. 5, a screw 22 that is to contact the circular wood member 13U, and a clamp body 21. The clamp body 21 includes: an arm member 21*u* extending along a longitudinal direction of the screw 22; a screw receiving member 21*r*, extending sideways from one end of the arm member 21*u*, to receive screwing of the screw 22; and an abutted member 21*t* that extends sideways from the other end of the arm member 21*u* and is abutted against the string instrument, whereby the clamp body 21 thus takes a substantially C-shape. The abutted member 21*t* is provided with a swelling 21*f* for attaining a point-contact with the string instrument. A tip of the screw 22 is provided with a round 22*m* for attaining the point-contact with the circular wood member 13U. The swelling 21*f* may be integrally formed of a wood configuring the abutted member 21*t*, or may alternatively be formed of a leather material pasted to the wood configuring the abutted member 21*t*, thereby making it hard to damage an underside of a top plate of the string instrument.

Note that each of the circular wood members 13U, 13B and the clamp body 21 is composed of spruce (which might be pronounced a bit differently in some cases in Japan) classified as one of evergreen high trees belonging to a pine family. On the other hand, the screw 22 is composed of a raw material instanced by such a resin and other equivalent materials that a helical shape may easily be formed. The pickup apparatus 1 is thus composed of the wood materials substantially on the whole, and the leg portions 14 for supporting the pickup apparatus body 10 at the tree points on the surface of the string instrument involve using the leathers that are light in weight similarly to the wood materials and are soft, resulting in becoming low in mass on the whole.

Figure 6:
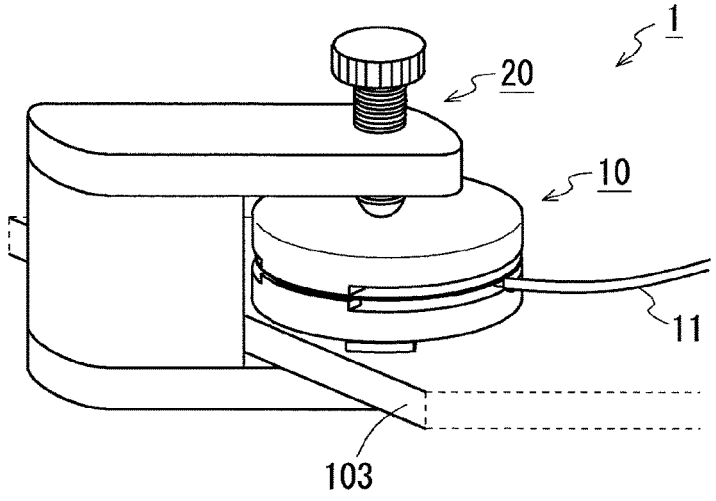
FIG. 6 is a view illustrating the pickup apparatus in a state of being fixed to a top plate of a body of a contrabass.

FIG. 6 is a view illustrating the pickup apparatus 1 in a state of being fixed to a top plate 103 of a body of a contrabass 101. The pickup apparatus 1 adopts a fitting structure, in which the pickup apparatus body 10 is fixed by the clamp 20 to the top plate of the body of the string instrument. In other words, the pickup apparatus 1 is not fitted to members other than the top plate of the body of the string instrument. Hence, when a performance is played by using the contrabass 101 with the pickup apparatus 1 being fixed to the top plate 103 of the body of the contrabass 101, it follows that the pickup apparatus 1 vibrates together with the top plate 103 of the body of the contrabass 101. The pickup apparatus 1 composed of the wood materials substantially on the whole becomes low in mass, and hence vibrations of the top plate 103 of the body of the contrabass 101 are not substantially depressed. Consequently, the pickup apparatus 1 actually attains behaviors given below.

Figure 7:
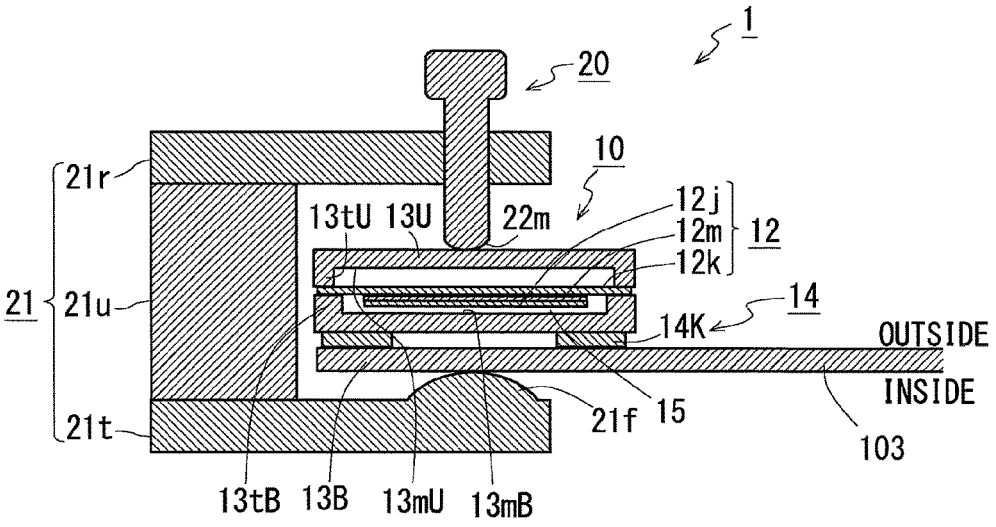
FIG. 7 is a view illustrating a structure of the pickup apparatus in the state of being fixed to the top plate of the body of the contrabass.

FIG. 7 is a view illustrating a structure of the pickup apparatus 1 in the state of being fixed to the top plate 103 of the body of the contrabass 101. The pickup apparatus body 10 is fixed by the clamp 20 to the top plate 103. In this case, when the top plate 103 of the body of the contrabass 101 is vibrated due to the performance, the vibrations of the top plate 103 are propagated to the pickup apparatus body 10 in parallel via two paths, i.e., a first propagation path along which to propagate the vibrations to the circular wood member 13U via the clamp body 21 and the screw 22 from the swelling 21*f* provided on the abutted member 21*t* of the clamp 20, and a second propagation path along which to propagate the vibrations to the circular wood member 13B via the leg portions 14. The circular wood members 13U, 13B of the pickup apparatus body 10 are thereby vibrated. The pickup apparatus 1 is light in weight and low in mass on the whole, and it is therefore inferred that the circular wood members 13U, 13B of the pickup apparatus body 10 are vibrated substantially in a same way as the top plate 103 of the body of the contrabass 101 is vibrated. When the circular wood members 13U, 13B of the pickup apparatus body 10 are vibrated, the piezoelectric element 12 interposed between the circular wood members 13U, 13B vibrates in a way that follows motions of the circular wood members 13U, 13B. However, the piezoelectric element 12 is in the state of contacting the protrusions 13*t*U, 13*t*U, 13*t*B, 13*t*B and being supported at the two points along the external peripheral edge of the lower electrode layer 12*k*, and therefore, when the circular wood members 13U, 13B vibrate, the piezoelectric element 12 is oscillated from both ends in such a manner that the overall piezoelectric element 12 gets flexural. In other words, the vibrations applied to the piezoelectric element 12 are propagated to the piezoelectric material layer 12*m* not locally but overall. The piezoelectric element 12 is supported simply at the two points along the external peripheral edge, and is thereby enabled to vibrate freely to some degrees. Therefore, in the piezoelectric element 12 getting flexural upon receiving the vibrations from the circular wood members 13U, 13B, the whole piezoelectric element 12 existing between the lower electrode layer 12*k* and the upper electrode layer 12*j* receives a pressure, and is thereby enabled to convert the sounds having large amplitudes especially in bass into the electric signals.

Note that according to experiments of some number of pickup apparatuses 1 experimentally manufactured by the inventor of the invention of the present application, it was confirmed that the pickup apparatus body 10 received the vibrations propagated more dominantly from the second propagation path via the leg portions 14 than from the first propagation path via the clamp 20.

According to experiments using experimental models experimentally manufactured by the inventor(s) of the invention of the present application with respect to variations other than the pickup apparatus 1, it was confirmed that there was a deficient low tone range due to hindrance of the free vibrations of the piezoelectric element 12 when the piezoelectric element 12 is supported at three or more protrusions other than the protrusions 13*t*U, 13*t*U, 13*t*B, 13*t*B, and acoustic sounds disappeared. In this point, these same phenomena were confirmed with respect to not only the string instrument like the contrabass but also other string instruments.

Figure 8A:
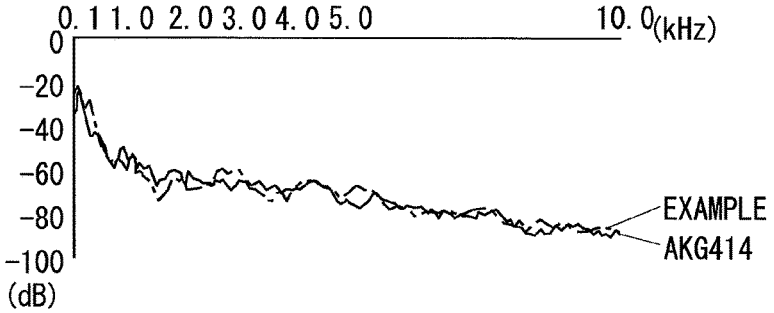
FIG. 8A is a first diagram illustrating comparative results between the pickup apparatus according to an embodiment and pickup apparatuses according to comparative examples.
Figure 8B:
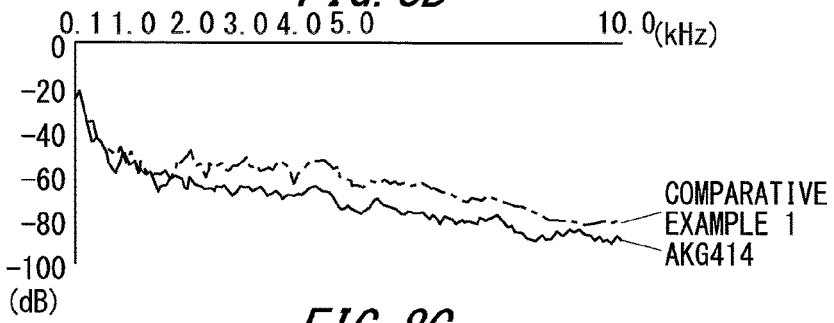
FIG. 8B is a second diagram illustrating comparative results between the pickup apparatus according to an embodiment and pickup apparatuses according to comparative examples.
Figure 8C:
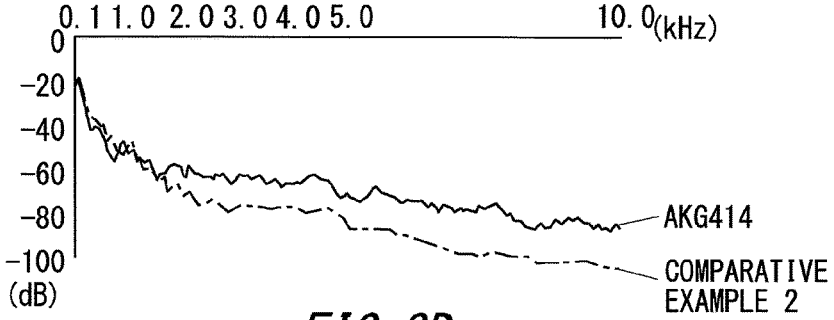
FIG. 8C is a third diagram illustrating comparative results between the pickup apparatus according to an embodiment and pickup apparatuses according to comparative examples.
Figure 8D:
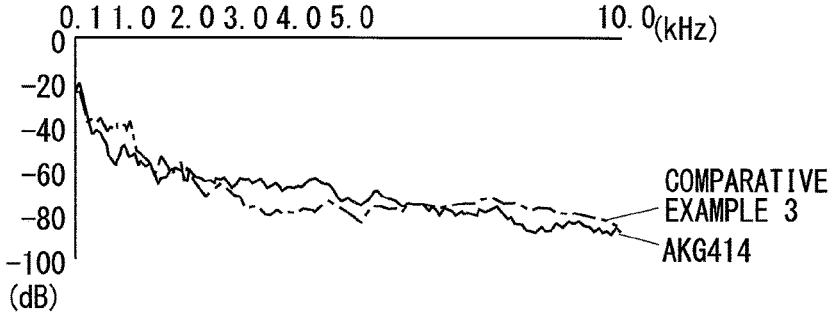
FIG. 8D is a forth diagram illustrating comparative results between the pickup apparatus according to the first modified example, which is fixed to an interior of the body of the string instrument.

FIG. 8A is a first diagram illustrating comparative results between the pickup apparatus 1 according to the embodiment (which will hereinafter be termed an "Example") and pickup apparatuses according to comparative examples. FIG. 8B is a second diagram illustrating comparative results between the pickup apparatus 1 according to the embodiment and pickup apparatuses according to comparative examples. FIG. 8C is a third diagram illustrating comparative results between the pickup apparatus 1 according to the embodiment and pickup apparatuses according to comparative examples. FIG. 8B is a forth diagram illustrating comparative results between the pickup apparatus 1 according to the embodiment and pickup apparatuses according to comparative examples. In each of four graphs illustrated in FIGS. 8A-8D, there are rendered two lines, i.e., one line given when sound signals obtained by the pickup apparatus fitted to the contrabass are expressed in a frequency domain, and another line given when the sound signals obtained by a microphone (a condenser microphone "AKG414" of AKG Acoustics) placed in a vicinity of the contrabass are expressed in the frequency domain. The microphone placed in the vicinity of the contrabass picks up the sounds emitted from the contrabass through the air, and hence the sound signals obtained by the microphone are assumed to be close to original sounds. Such being the case, this comparison evaluates performances of the pickup apparatus of the Example and the pickup apparatus of the comparative example on the basis of waveforms of the sound signals obtained by the microphone. FIG. 8A illustrates the waveform in the Example and the waveform of the microphone. FIG. 8B depicts the waveform of such a type of pickup apparatus (which will hereinafter be referred to as a "comparative example 1") that the piezoelectric element is disposed on an upper portion of a bridge, which is closest to the strings, and the waveform of the microphone. FIG. 8C illustrates the waveform of such a type of pickup apparatus (which will hereinafter be referred to as a "comparative example 2") that the piezoelectric element is interposed between bridge feet and the top plate (spruce), and the waveform of the microphone. FIG. 8D depicts the waveform of such a type of pickup apparatus (which will hereinafter be referred to as a "comparative example 3") that a contact condenser microphone is disposed in a gap between the bridge feet, and the waveform of the microphone. Note that FIGS. 8A-8D depict the respective waveforms separately in the four graphs (FIGS. 8A-8D; and, however, these waveforms are each recorded simultaneously. Hence, each of the respective waveforms of "AKG414", which are rendered in FIGS. 8A-8D, takes the same form.

As illustrated in FIG. 8A, it is understood that the Example obtain substantially the same sound signals as the original sounds. On the other hand, it is understood that each of the comparative examples 1-3 obtains the sound signals slightly apart from the original sounds. For instance, the comparative example 1 has such a tendency that the sounds are close to the original sounds in the bass range, the sounds louder than the original sounds are obtained in middle and high ranges, and high-pitched sounds are crunchy and harsh sounds and have no acoustic feeling even when listening to these sounds actually by ears. For instance, the comparative example 2 has such a tendency that the sounds are close to the original sounds in the bass range, the sounds smaller than the original sounds are obtained in middle and high ranges, and middle- and high-pitched sounds are uncomfortable sounds like stuffing a nose as being peculiar to the middle and high ranges when listening to these sounds actually by the ears. For instance, the comparative example 3 has such a tendency that the sounds are close to the original sounds in the middle and high ranges, the sounds louder than the original sounds are obtained in the bass range, and the sounds in the bass range are not clear conspicuously at rises of the sounds when listening to these sounds actually by the ears.

As will be comprehended from the comparative results described above, it is understood that the pickup apparatus 1 according to the embodiment acquires the sound signals closer to the original sounds than any of the comparative examples 1-3 described above.

Note that the pickup apparatus 1 according to the embodiment may be modified as follows.

The pickup apparatus 1 according to the embodiment includes the leg portions 14 configured by the three leather portions 14*k*, 14*k*, 14*k*, and may also be a pickup apparatus including leg portions configured by two leather portions or four or more leather portions or other materials.

In the pickup apparatus 1 according to the embodiment, the piezoelectric element 12 is interposed between the circular wood members 13U, 13B in such a state that the upper electrode layer 12*j* being smaller in diameter than the lower electrode layer 12*k* is directed toward the leg portions 14; and, however, the piezoelectric element 12 may also be interposed between the circular wood members 13U, 13B in a state of being directed opposite.

The pickup apparatus 1 according to the embodiment may also be fixed to the musical instrument without using the clamp 20.

Figure 9:
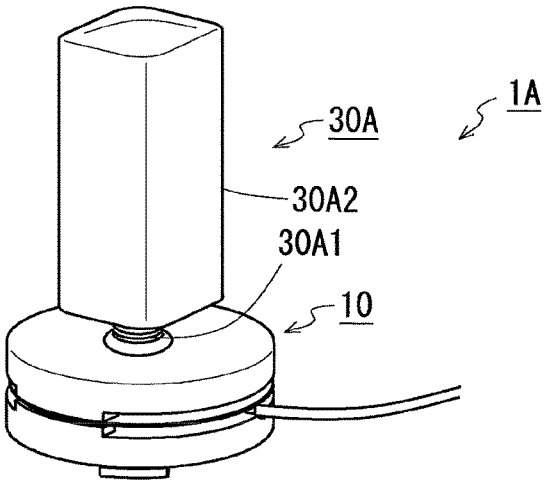
FIG. 9 is a view illustrating a first modified example of a pickup apparatus according to the embodiment.

FIG. 9 is a view illustrating a first modified example of the pickup apparatus 1 according to the embodiment. A pickup apparatus 1A according to the first modified example includes a stopper 30A provided on the circular wood member 13U of the pickup apparatus body 10. The stopper 30A has a male screw 30A1 formed protrusively from the surface of the circular wood member 13U, and a column-shaped wood piece 30A2 screwed to the male screw 30A1. The stopper 30A is stretched and contracted by rotating the wood piece 30A2 relatively to the pickup apparatus body 10. The pickup apparatus 1A according to the first modified example is thereby enabled to be fixed to, e.g., an interior of the body of the string instrument.

Figure 10:
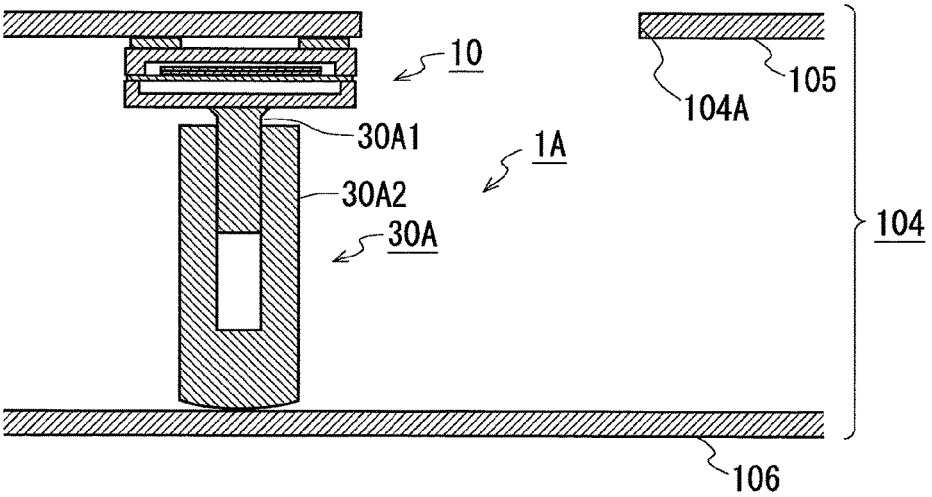
FIG. 10 is a view illustrating the pickup apparatus according to the first modified example, which is fixed to an interior of the body of the string instrument.

FIG. 10 is a view illustrating the pickup apparatus 1A according to the first modified example, which is fixed to the interior of the body of the string instrument. The pickup apparatus 1A according to the first modified example is fixable to the interior of a body 104 of each of a variety of string instruments instanced by a guitar and the contrabass. For instance, a user disposes the pickup apparatus 1A between a top plate 105 and a back plate 106 that configure the body 104 through a hole 104 provided in the body 104 of the string instrument, and stretches and contracts the stopper 30A by rotating the wood piece 30A2 relatively to the pickup apparatus body 10 in this state, thereby enabling the pickup apparatus 1A to be fixed by being tightened between the top plate 105 and the back plate 106.

Figure 11:
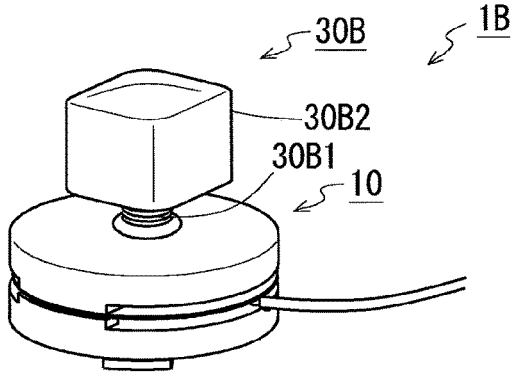
FIG. 11 is a view illustrating a second modified example of the pickup apparatus according to the embodiment.

FIG. 11 is a view illustrating as second modified example of the pickup apparatus 1 according to the embodiment. A pickup apparatus 1B according to the second modified example includes a stopper 30B provided on the circular wood member 13U of the pickup apparatus body 10. The stopper 30B has a male screw 30B1 formed protrusively from the surface of the circular wood member 13U, and a substantially regular hexahedron wood piece 30B2 screwed to the male screw 30B1. The stopper 30B is stretched and contracted by rotating the wood piece 30B2 relatively to the pickup apparatus body 10.

Figure 12:
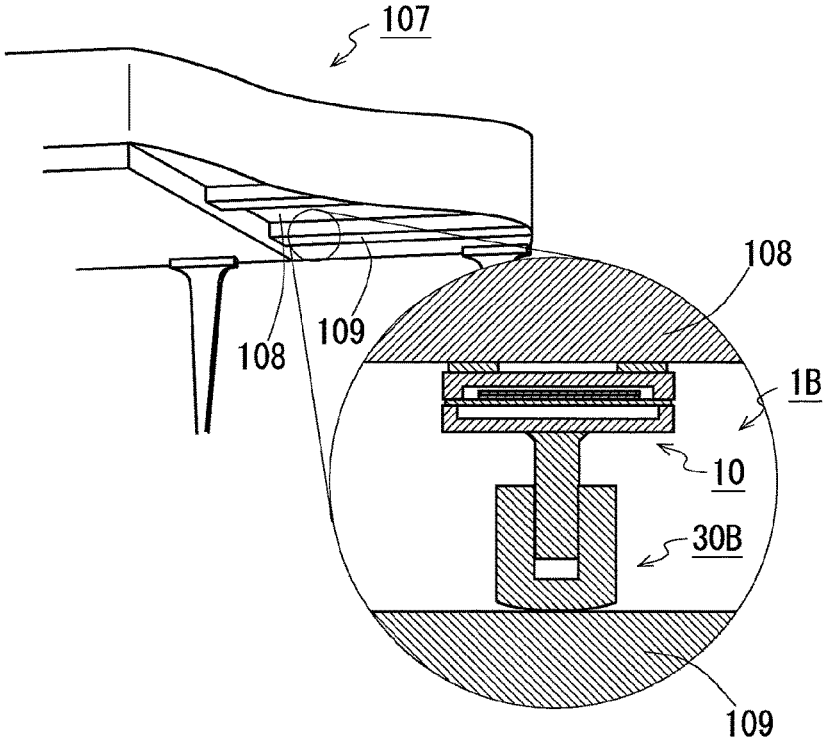
FIG. 12 is a view illustrating the pickup apparatus according to the second modified example, which is fixed to a piano.

FIG. 12 is a view illustrating the pickup apparatus 1B according to the second modified example, which is fixed to a piano. A piano 107 is provided with a soundboard 108 arranged substantially in parallel in an interior of the piano 107. The piano 107 is also provided with straight support poles 109 arranged on an underside of the soundboard 108 in parallel with the soundboard 108. The straight support poles 109 are classified as one of structural materials of the piano 107, and function as the structural material for supporting a keyboard, legs, a frame and other components. The pickup apparatus 1B according to the second modified example has the substantially regular hexahedron wood piece 30B2 smaller than the wood piece 30A2 of the pickup apparatus 1A according to the first modified example, and is therefore fixable to a narrow area such as between the soundboard 108 and the straight support pole 109 of the piano 107. To be specific, the user disposes the pickup apparatus 1B between, e.g., the soundboard 108 and the straight support pole 109 of the piano 107, and stretches and contracts the stopper 30B by rotating the wood piece 30B2 relatively to the pickup apparatus body 10 in this state, thereby enabling the pickup apparatus 1B to be fixed by being tightened between the soundboard 108 and the straight support pole 109.

The pickup apparatus 1 according to the embodiment is, even when modified into, e.g., the pickup apparatus 1A according to the first modified example and the pickup apparatus 16 according to the second modified example, enabled to convert the sounds of the musical instruments into the electric signals preferably.

DESCRIPTION OF THE REFERENCE NUMERALS AND SYMBOLS

1, 1A, 1B. . . pickup apparatus: 10. . . pickup apparatus body: 11. . . coaxial cable: 11*s*. . . external conductor: internal conductor: 12. . . piezoelectric element: 12*k*. . . lower electrode layer: 12*m*. . . piezoelectric material layer: 12*j*. . . upper electrode layer: 13U, 13B. . . circular wood member: 13*t*U, 13*t*B. . . protrusion: 13*m*U, 13*m*B. . . opposite surface: 14. . . leg portion: 14*k*. . . leather portion: 15. . . air gap: 20. . . clamp: 21. . . clamp body: 21*u*. . . arm member: 21*r*. . . screw receiving member: 21*t*. . . abutted member: 21*f*. . . swelling: 22. . . screw: 22*m*. . . round: 30A, 30B. . . stopper: 30A1, 30B1. . . male screw: 30A2, 3062. . . wood piece: 101. . . contrabass: 102. . . f-hole:

103. . . top plate: 104. . . body: 104A. . . hole: 105. . . top plate: 106. . . back plate: 107. . . piano: 108. . . soundboard: 109. . . straight support pole

The invention claimed is:

1. A pickup apparatus, for a musical instrument, to be fixed to the musical instrument, comprising:

a disc-shaped piezoelectric element;

a couple of circular members receiving interposition of the piezoelectric element therebetween; and leg portions being arranged on a surface of any one of the couple of circular members, each circular member including protrusions formed protrusively toward the other circular member in two positions along a peripheral edge of an opposite surface in a face-to-face relationship with the other circular member, and the piezoelectric element being supported within an air gap formed by the protrusions between the couple of circular members in a state of the piezoelectric element being interposed between the protrusions possessed by respective circular wood members.

2. The pickup apparatus for the musical instrument according to claim 1, wherein the piezoelectric element includes a circular lower electrode layer, a piezoelectric material layer smaller in diameter than the lower electrode layer, and an upper electrode layer formed on the piezoelectric material layer, and the lower electrode layer is interposed between the couple of circular members in a state of contacting the protrusions.

3. The pickup apparatus for the musical instrument according to claim 1, wherein the leg portions are configured by leather portions arranged equally at three points along an edge of a surface of any one of the circular members.

4. The pickup apparatus for the musical instrument according to claim 1, wherein the protrusions are arranged symmetrically about a central point of each circular member.

5. The pickup apparatus for the musical instrument according to claim 1, wherein the musical instrument is a string instrument having an f-hole, and the pickup apparatus for the musical instrument is fixed by a clamp to an edge of the f-hole.

6. The pickup apparatus for the musical instrument according to claim 5, wherein the clamp is composed of a wood material with respect to members other than a screw contacting the circular member.

7. The pickup apparatus for the musical instrument according to claim 1, wherein the circular member is composed of the wood material.

8. The pickup apparatus for the musical instrument according to claim 6, wherein each of the wood materials is spruce.

* * * * *